US005451273A

United States Patent [19]

Howard et al.

[11] Patent Number: 5,451,273

[45] Date of Patent: Sep. 19, 1995

[54] CAST ALLOY ARTICLE AND METHOD OF MAKING AND FUEL FILTER

[75] Inventors: Kathy D. Howard; Paul E. Howard, both of Arvada, Colo.

[73] Assignee: Hydro-Petro Technology, Inc., Wheat Ridge, Colo.

[21] Appl. No.: 360,950

[22] Filed: Dec. 21, 1994

Related U.S. Application Data

[63] Continuation-in-part of Ser. No. 114,449, Aug. 31, 1993, abandoned, which is a continuation-in-part of Ser. No. 983,970, Dec. 1, 1992, abandoned.

[51] Int. Cl.[6] ..... C22C 1/02; F02M 27/00

[52] U.S. Cl. ..... 148/442; 148/400; 148/538; 123/537; 123/538

[58] Field of Search ..... 148/538, 553, 433, 442, 148/400; 420/473, 476, 587; 164/485, 122; 123/1 A, 3 A, 536, 537, 538

[56] References Cited

U.S. PATENT DOCUMENTS

| | | | |
|---|---|---|---|
| 2,976,192 | 3/1961 | Saarivirta et al. | 148/553 |
| 3,448,034 | 6/1969 | Craft | 204/197 |
| 3,486,999 | 12/1969 | Craft | 204/197 |
| 3,835,015 | 9/1974 | Gary | 204/197 |
| 3,891,394 | 6/1975 | Smith et al. | 204/197 |
| 4,429,665 | 2/1984 | Brown | 123/3 |
| 4,715,325 | 12/1987 | Walker | 123/538 |
| 4,930,483 | 6/1990 | Jones | 123/538 |
| 4,959,155 | 9/1990 | Gomez | 210/687 |
| 5,048,499 | 9/1991 | Daywalt | 123/538 |
| 5,059,217 | 10/1991 | Arroyo et al. | 123/1 A |
| 5,197,446 | 3/1993 | Daywalt et al. | 123/538 |
| 5,305,725 | 4/1994 | Marlow | 123/538 |
| 5,344,606 | 9/1994 | Brimmer | 148/434 |

*Primary Examiner*—David A. Simmons

*Assistant Examiner*—Sikyin Ip

*Attorney, Agent, or Firm*—Ancel W. Lewis, Jr.

[57] ABSTRACT

A cast alloy article suitable for improving the combustion characteristics and efficiency of a liquid fuel is disclosed. This cast alloy article is chiefly characterized by having coarse and irregular surface contour of interspersed peaks, valleys and pores that provide for increased surface area for increased fluid contact and provide for increased turbulence in fluid flow. The article has interspersed dendritic areas of solid dendrites and interdendritic areas of solid metal that also provide maximum surface area contact and turbulence of fluid flow of a fluid that is passed over the surface thereof. This article is made by heating selected quantities of selected metals including copper, zinc, nickel and tin to a temperature of above about 2000° F. but not in excess of 2400° F. intermixing the heated metals, pouring the heated metals into sand mold of a particular mesh to accomplish a coarse and irregular contour with pores and retaining the poured body at a temperature between about 2000° F. and 800° F. for a period of at least 24 hours to form solid dendrites. A cast alloy body of cylindrical form with longitudinal flutes or grooves in a tubular casing has liquid fuel passed through the casing and in contact with the body. An increase in zinc from about 23% to about 28–30% results in markedly higher electrical conductivity. A fuel filter has four of the cores arranged symmetrically about a longitudinal center line of a housing to form a longitudinal flow passage. Metal particles of the same material as the core surround the cores. An intermediate fuel filter between the housing and metal particles and at the inlet and outlet ends of the housing remove impurities from the filter. The fuel is passed over the cores and metal particles in passing between the inlet and outlet.

23 Claims, 6 Drawing Sheets

CAST ALLOY ARTICLE AND METHOD OF MAKING AND FUEL FILTER

This application is a continuation-in-part of application Ser. No. 114,449 filed Aug. 31, 1993, now abandoned which is a continuation-in-part of application Ser. No. 983,970 filed Dec. 1, 1992, now abandoned.

TECHNICAL FIELD

This invention relates to cast alloy articles and a method for making a cast alloy article suitable for improving the combustion characteristics and efficiency of a liquid fuel brought into contact with the article. This invention further relates to a fuel filter through which liquid fuel is passed.

BACKGROUND ART

Brown U.S. Pat. No. 4,429,665 suggests using a metal bar comprising an alloy of nickel, zinc, copper, tin and silver to improve the combustion characteristics of a liquid fuel that is passed over the surface of the metal bar.

Craft U.S. Pat. Nos. 3,448,034 and 3,486,999 as well as Gomez U.S. Pat. No. 4,959,155 disclose cast alloys having fluids passed thereover for different purposes.

DISCLOSURE OF THE INVENTION

A cast alloy article made in accordance with a particular method has a shiny, coarse, and irregular surface contour of interspersed peaks, valleys and pores that provide for increased surface area for increased fluid contact and for increased turbulence in fluid flow. The article has interspersed dendritic and interdendritic areas having selected proportions of several metals. The method of making includes heating selected quantities of selected metals including copper, zinc, nickel and tin to a high temperature above about 2000° F. but not in excess of 2400° F., thoroughly intermixing the heated metals, pouring the mixed heated metals into a sand mold having sand having a selected mesh size, slowly cooling the heated metals immediately after reaching the high temperature, and retaining the poured body at a temperature between about 2000° F. and 800° F. for a period of about 24 hours for slow cooling to form interspersed dendritic areas and interdendritic areas. A cast alloy article of a particular shape enhances surface area contact and turbulence in fluid flow. A liquid fuel passed over the core has been found to improve the combustion efficiency and characteristics of the liquid fuel.

A fuel filter disclosed has four of the fluted cast alloy bodies in a circumferentially spaced arrangement in a metal housing to form a central flow passage. Metal particles of the same material as the core surround the cores. An intermediate fuel filter between the housing and metal particles and inlet and outlet fuel filters remove impurities from the fuel as fuel is passed from the inlet, through the filters and over the cores and metal particles.

BRIEF DESCRIPTION OF THE DRAWINGS

Details of this invention are described in connection with the accompanying drawings which like parts bear similar reference numerals in which.

DETAILED DESCRIPTION

Figure 1:
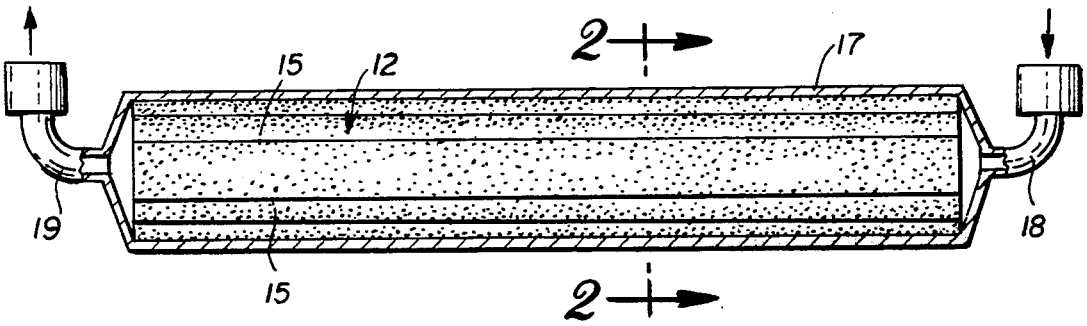
FIG. 1 is a side elevation view of a cast alloy article embodying features of the present invention with portions of the housing and inlet and outlet pipes broken away to show internal parts.

A cast alloy article shown embodying features of the present invention is formed as a fluted cylindrical body 12 of a selected diameter and selected length. The cast alloy body 12 shown has a generally circular cross section with two intermediate longitudinal grooves 13 and 14 and two side longitudinal grooves 15 and 16 in each half section which form channels along which a fluid in contact with the surface will flow. This shape or configuration has been found to provide increased surface area contact and provide turbulence in the flow of the fluid over the body. The cast body 12 is mounted in a cylindrical housing 17, preferably made of copper, with an inlet pipe 18 and an outlet pipe 19 coupled thereto to pass fluid over the cast body 12.

Referring now to FIGS. 3–8 the cast body 12 has a shiny, coarse, irregular surface contour of interspersed peaks 21, valleys 22 and pores 23. This surface contour increases the surface contact area for the fluid flowing thereover. This coarse, irregular surface containing pores also produces turbulence in the fluid flow.

A cast alloy article made according to a method of the present invention uses selected quantities of copper, zinc, nickel and tin which are heated to a temperature of above about 2000° F. but not in excess of 2400° F. An example of selected quantities by weight are:

| | |
|---|---|
| copper | about 46–50% |
| nickel | about 19–23% |
| zinc | about 21 to 24% |
| tin | about 6 to 10% |

Optimal or preferred quantities are:

| | |
|---|---|
| copper | about 48% |
| nickel | about 21% |
| zinc | about 23% |
| tin | about 8% |

Figure 7:
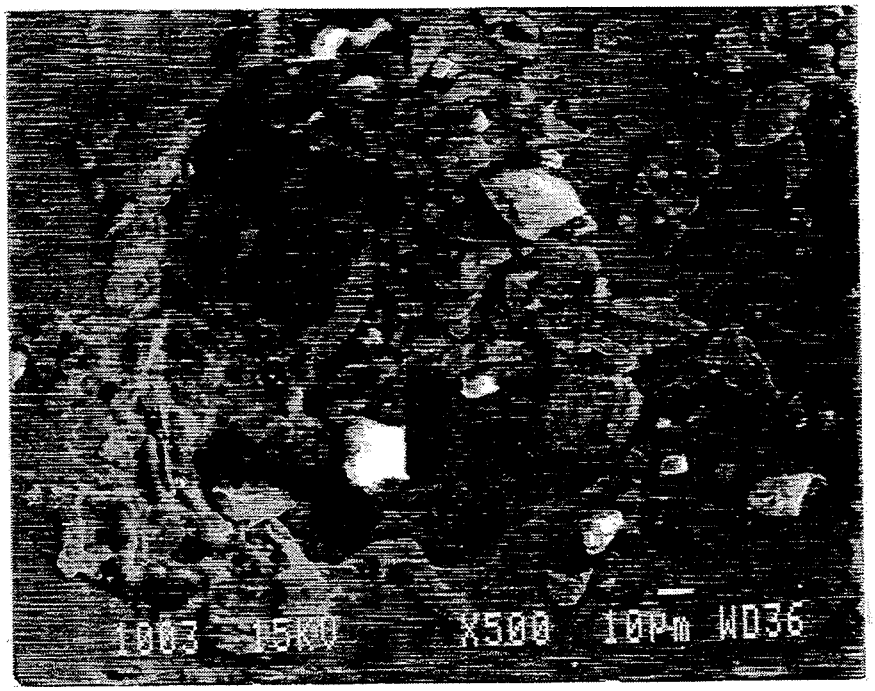
FIG. 7 is a scanning electron microscope of a segment of the cast alloy article of FIG. 4 at 500 power magnification.
Figure 8:
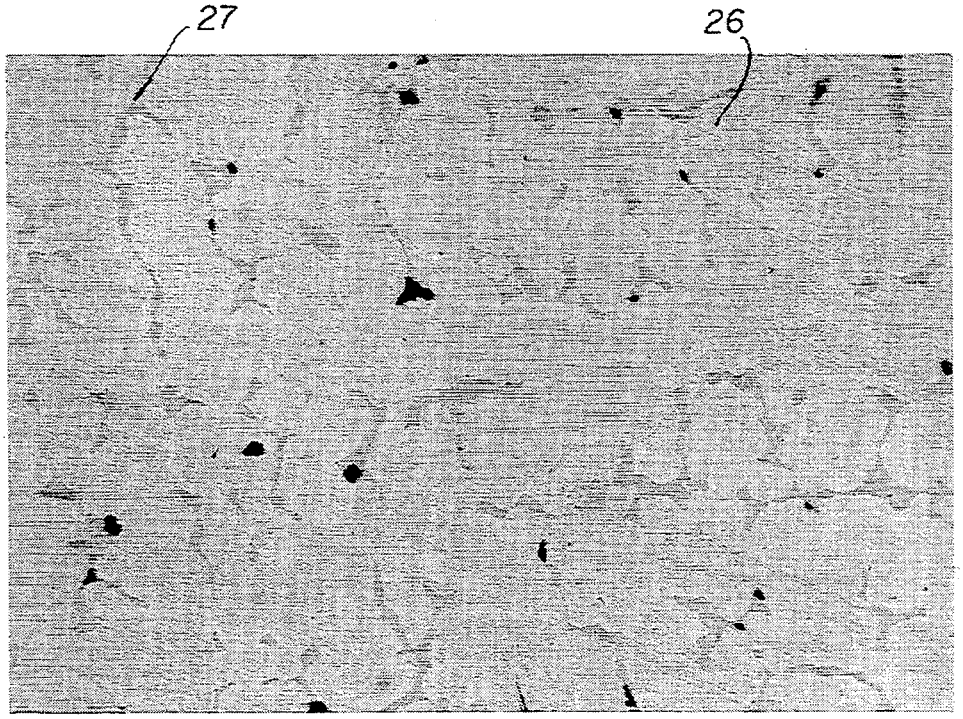
FIG. 8 is a scanning electron microscope of the cast alloy article at 350×power magnification.
Figure 9:
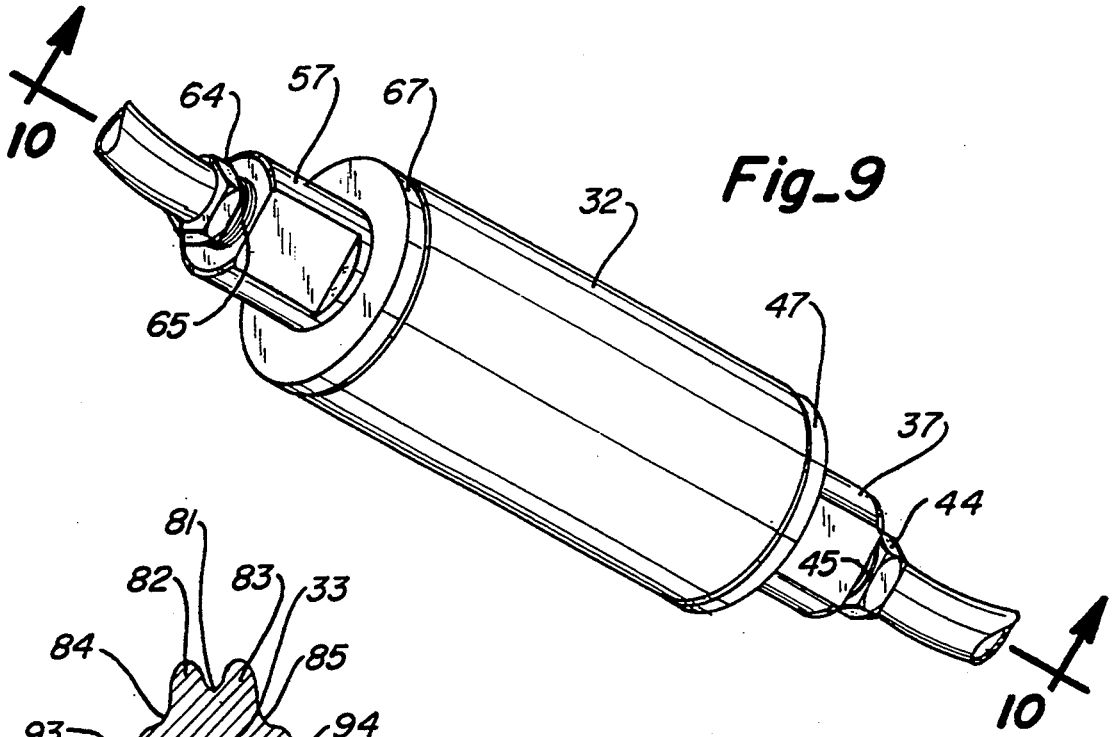
FIG. 9 is a perspective view of a fuel filter embodying features of the present invention.

The heated metals are thoroughly intermixed and then poured into a sand mold with the sand preferably between about 80 mesh to 140 mesh to provide the coarseness and irregularity in the surface. The optimal or preferred is about 120 grain olivine or about 100 black. During the mixing and melting selected quantities of metal are added to attain the desired metal proportions. The heated metals are slowly cooled after reaching the highest temperature. The mold size is thick enough to allow slow cooling. The mold size is short enough to be sure molten alloy is liquid enough at both ends. Each core or cast body 12 is sized in relation to flow rate to accomplish turbulent flow. The poured body is retained at a temperature of between 2000° F. and 800° F. for a period of about 24 hours to provide for a slow cooling. A slow cooling achieves the proper crystalline structure. This forms dendritic areas 26 and interdendritic areas 27. The cast alloy article has a cast microstructure with a dendritic appearance. Dendrites are solid crystals that become evident as the cast metals slowly cool through the solidification range. Dendrites grow during solidification until they interfere with each other. Each dendritic area is solid dendrites and has a tree branching pattern. Referring now to FIGS. 7 and 8 the light colored continuous region or area is the dendritic area. The darker, grey particles are the interdendritic areas. The center to center spacing between each tree-like branch of the dendrites is about 0.001 to 0.002 inch. The solid dendrites have by weight percent about 53% copper, about 23% nickel, about 20% zinc and about 3% tin. Each interdendritic area is solid metal preferably having a weight percent of about 34% copper, about 27% nickel, about 7% zinc and about 30% tin.

The above cast alloy article when placed in a core and has liquid fuel passed in contact therewith via the inlet and outlet pipes has been found to enhance the combustion characteristics and efficiency of a liquid fuel such as gasoline and diesel fuel. In particular, laboratory tests run on stationary engines revealed significant changes in aromatics, olefins and saturates as a result of passing the fuel over a cast alloy article in a housing as shown and described herein. The article has shown increased efficiency, cleaner burning and a reduction in pollutant emissions including hydrocarbons, carbon monoxide and oxides of nitrogen.

Although it is not fully understood, the flow of the fuel over the cast alloy article is believed to alter the fuel so as to cause more efficient combustion. This action has been explained as a catalytic treatment action caused by the surface of the article. It is believed that when the fuel flows over the surface there is a natural movement of electrons induced at the fluid interface surfaces which, in turn, activates the electrons in the fuel and turbulent mixing occurs because of the rough surface. It is theorized that as more electrons are activated and the fuel molecules are turbulently mixed. These molecules re-arrange into smaller clusters which enhance the combustion process as smaller fuel molecules are easier to vaporize and, in turn, burn more completely during the combustion cycle.

Improved results particularly for enhanced combustion efficiency of liquid fuels have been obtained by increasing the content of the zinc.

An example of a range of quantities by weight with increased zinc are:

| | |
|---|---|
| Copper | 41–45% |
| Nickel | 18–24% |
| Zinc | 27–31% |
| Tin | 6–8% |

Two specific examples of selected quantities by weight for the article having more zinc than the prior examples are:

| | Example A | Example B |
|---|---|---|
| Copper | 42% | 44% |
| Nickel | 23% | 19% |
| Zinc | 28% | 30% |
| Tin | 7% | 7% |

The procedure followed for making the cast alloy article for the above articles with increased zinc was as follows.

The furnaces were started and 60 pounds of the material to be heated was put in a crucible disposed on a fire. While the crucible and contents were heated the molds containing sand were prepared. The material in the crucible was heated to 2200° F. and the temperature was continuously tested by a probe. Next the mold was heated with a torch to remove the water from the sand. This was necessary to reduce flashing of the metals during pouring caused by the increase in zinc content and temperature.

Throughout the process of bringing the alloy to the required temperature zinc had been lost under the prior process as zinc would escape as smoke and gas. Whenever necessary, a covering of sand was placed on the surface of the molten metal to reduce the amount of zinc that became gaseous and enter the air. This was repeated whenever zinc started to be lost.

Immediately before the pour, the temperature was verified by probe to be at 2200° F. Then six pounds of zinc (or about 10% of the total batch) was plunged to the bottom of the crucible and stirred. The mixture was poured into the molds and allowed to cool for a period of 24 hours. The batch was tested and had succeeded in increasing the amount of zinc retained by about 43%. These cores had a substantially higher electrical conductivity than by the previously described article with less zinc.

Figure 5:
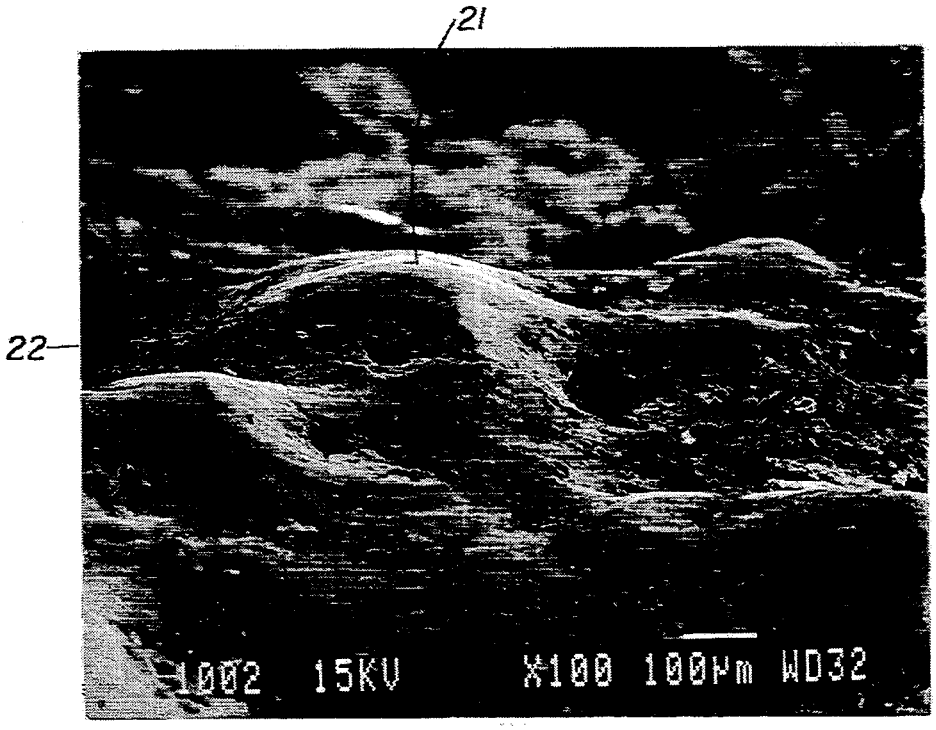
FIG. 5 is a scanning electron microscope of the cast alloy article at 100 power magnification.
Figure 6:
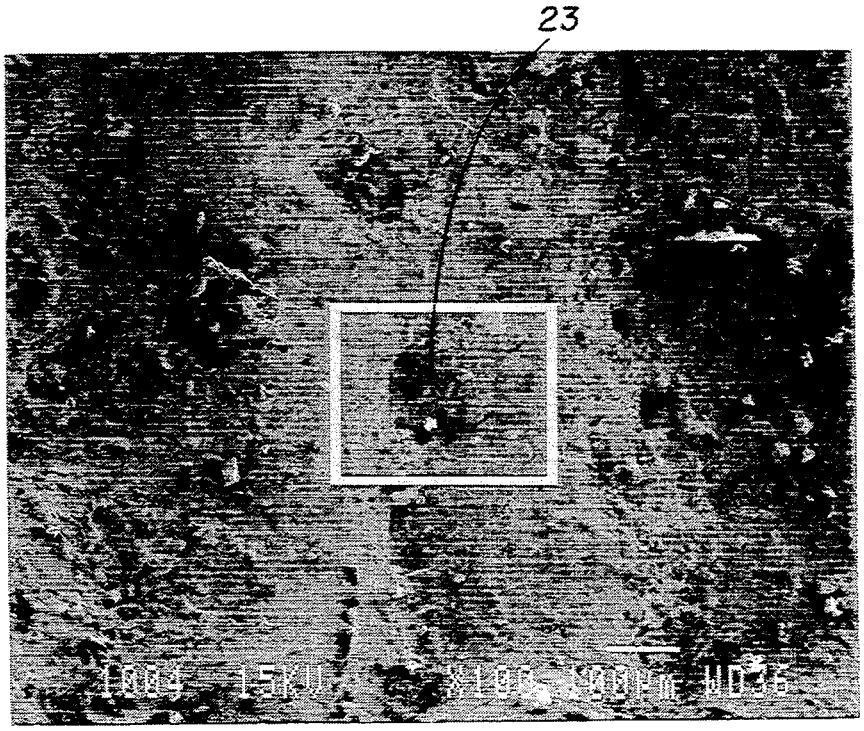
FIG. 6 is a scanning electron microscope of the cast alloy article at 100 power magnification with the target showing a pore.

In the casting process the sand of the size above described is secured as by glue to the mold pattern so that when the mold pattern is placed against the sand mold impressions are made in the cast body or core to provide the coarseness or roughness on the surface as is shown in FIGS. 5 and 6. The cast surface of the core may be generally defined as a "sand paper finish" surface. Through the casting process the metal changes in density from the peaks of the surface to the valleys of the surface causing the valleys to fracture and the peaks to harden. This opens the grains of the metal. The peaks are on the outside of the cast and cool first. On any cast surface the cold side of the part will always be solid and the cold side becomes grainy or open. The mold pattern is treated with a grain to achieve about a 60 to 80 grit finish. This coarse finish is used to add surface amplification to the core and also allows the valleys to become more porous. About 20% more surface area is achieved with this method.

The fuel filter shown in FIGS. 9–12 comprises a metal cylindrical housing 32, four identical cast alloy cores 33 in the housing. Each core 33 is a cast body and has opposed tapered end portions 33*a* and 33*b* at both ends. A mass of metal particles preferably shavings 34 of the same material as the core surround the core. A cylindrical intermediate fuel filter 35 is disposed between the housing and the metal shavings 34. The intermediate filter 35 shown is made from a strip of filter material, preferably paper such as brown cellulose with a $\frac{1}{4}$ inch pleat, formed with a series of outside folds 35*a* and inside folds 35*b* arranged in a sinuous pattern that extends a full circle about the center of the housing. The metal shavings are made by pouring the same alloy into a disc preferably 10 inches in diameter and 5 inches thick to achieve the same characteristics as the core. The disc formed is placed on a lathe and shavings are cut by turning the disc and using a hardened blade cutting tool to cut the disc into shavings. The shavings average about 0.01 inch thickness and about 0.25 inch in length.

An inlet end cap 37 with external threads 38 and threads into internal threads 39 adjacent the inlet end of the housing. Inlet end cap 37 has an internal throughbore 41 with internal threads 43. An inlet fitting 44 has external threads 45 that thread into the internal threads 43 of the inlet end cap 37. The inlet end cap 37 has intermediate flange portion 47 of maximum diameter that abuts against the inlet end of the housing 32 and an annular groove 48 between the flange portion 47 and the inner portion with external threads 45 that contain an O-ring 49 to seal the inner end of the housing against liquid fuel leakage. The inlet end cap 37 has an internal bore 51 larger than bore 41 that receives an inlet disc-shaped filter medium 52 preferably of nylon fiber, a metal screen 53 of stainless mesh, and another disc-shaped filter medium 54 arranged so that fuel is passed through the inlet passage through the fuel mediums 52 and 54 and into the central part of the housing.

An outlet end cap 57 is similar in size and similar construction to the inlet end cap 37 so that a description of one applies to both. Outlet end cap 57 has external threads 58 and threads into internal threads 59 adjacent the outlet end of the housing. Outlet end cap 57 has an internal throughbore 61 having internal threads 63. An outlet fitting 64 has external threads 65 that thread into the internal threads 63 of the outlet end cap 57. The outlet end cap 57 has intermediate flange portion 67 of maximum diameter that abuts against the outlet end of the housing 32 and an annular groove 68 between the flange portion 67 and the inner portion with external threads 58 that contain an O-ring 69 to seal outlet end of the housing against fuel leakage. The outlet end cap 57 has an internal bore 71 that receives an outer disc-shaped filter medium 72, a metal screen 73, and another disc-shaped filter medium 74 arranged so that fuel is passed through the outlet passage 61 and through the passage in the outlet fitting 64.

Figure 12:
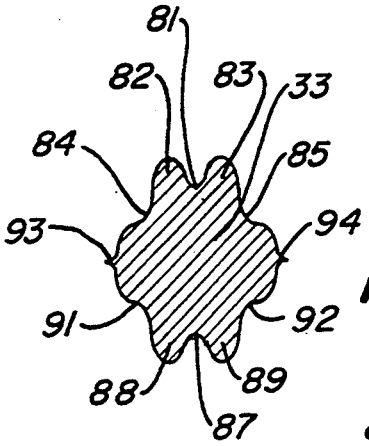
FIG. 12 is an enlarged cross-sectional view of one core.
Figure 11:
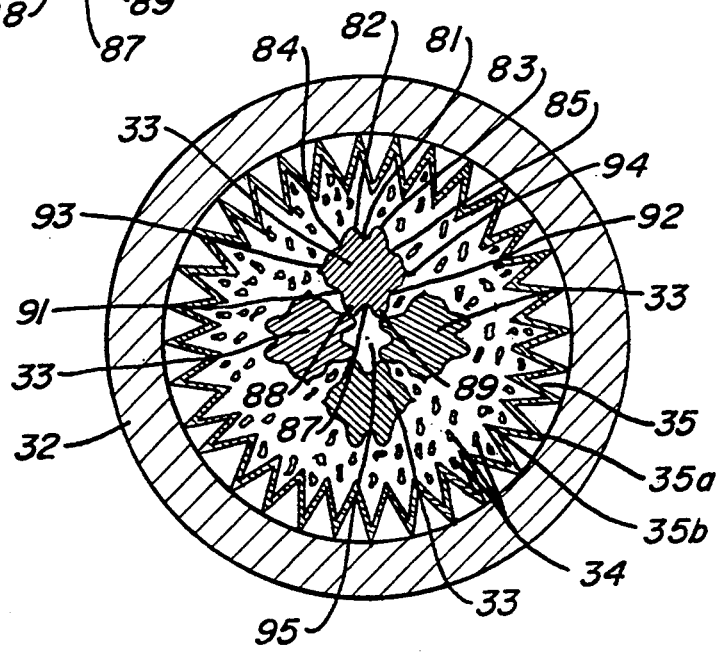
FIG. 11 is a sectional view taken along line 11—11 of FIG. 10.
Figure 10:
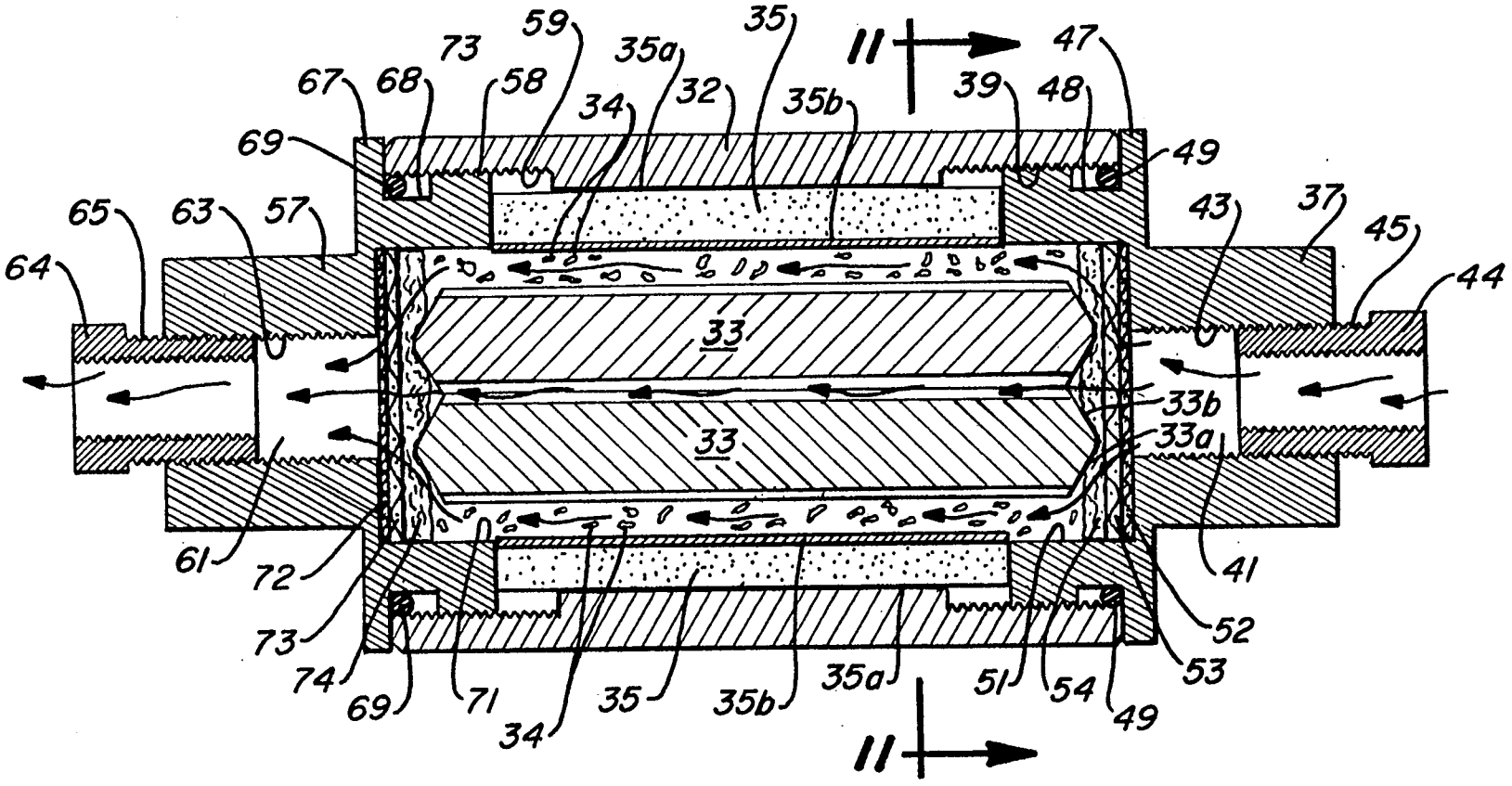
FIG. 10 is a sectional view taken along line 9—9 of FIG. 9.

As seen in FIGS. 11 and 12 the specific cross-section of each core 33 will now be described. Each core 33 has a generally circular cross section and a central groove 81 in the periphery extending along a first center line through the center of said core with a pair of spaced first and second peak portions 82 and 83 on each side of the central groove 81. A first side groove 84 and a second side groove 85 are provided at the side of the first and second peak portions. Each core has a second central groove 87 opposite said first groove 81 and a pair of spaced third and fourth peak portions 88 and 89 opposite the first and second peak portions, respectively. Third and fourth side groove portions 91 and 92 are opposite the first and second side groove portions extending along said second groove a center line transverse to the first center line. The core 33 further has side portions 93 and 94. The four cores form a central flow passage 95. An alternative embodiment would have a single core of the same shape disposed in the center of the housing 32 instead of the four cores.

Figure 2:
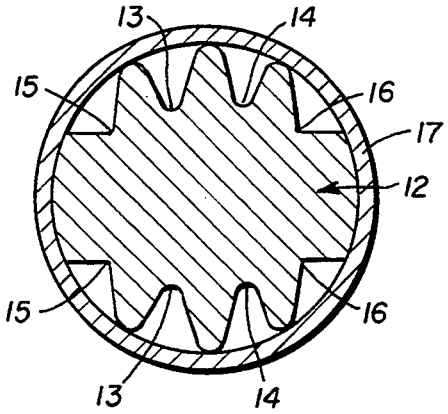
FIG. 2 is a sectional view taken along line 2—2 of FIG. 1.
Figure 3:
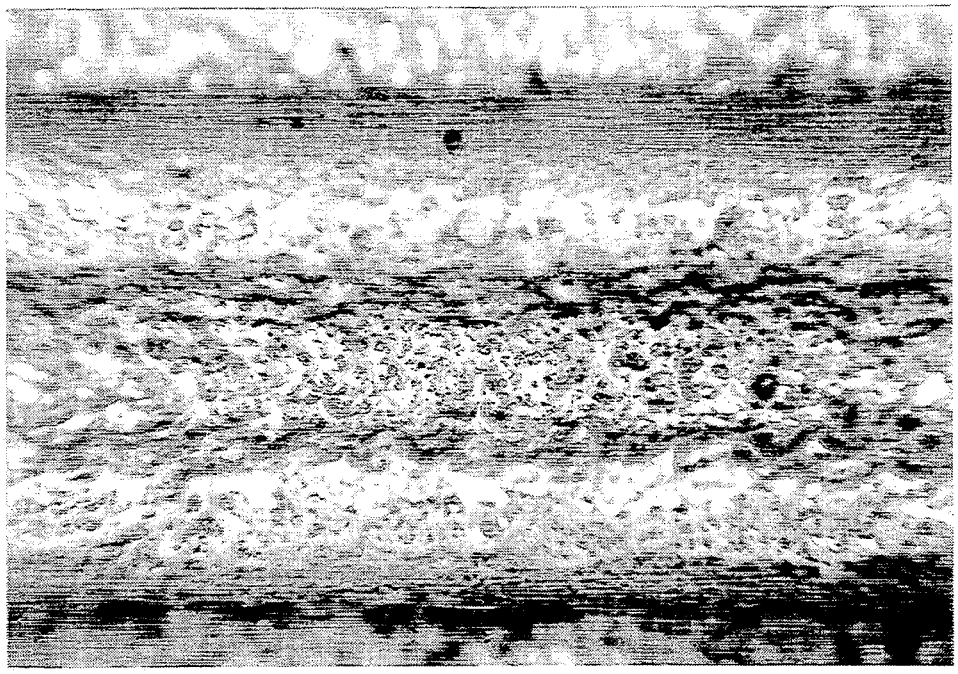
FIG. 3 is an optical microscope photograph of the cast alloy article shown in FIG. 1 at 8 power magnification.
Figure 4:
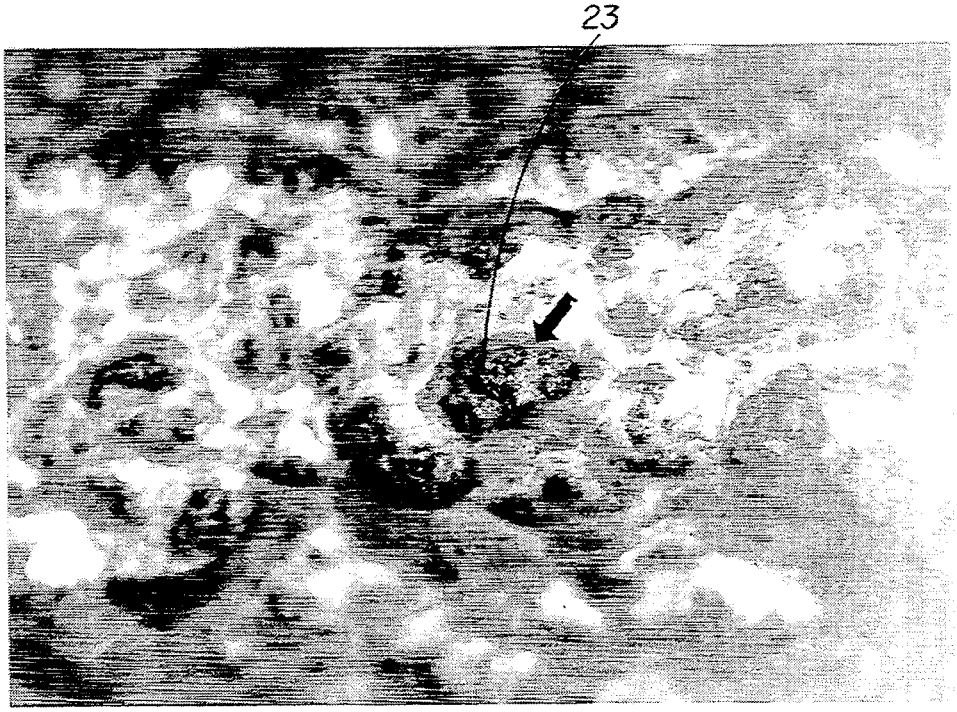
FIG. 4 is an optical microscope photograph of the cast alloy article at 20 power magnification.

By way of illustration and not limitation the core shown in FIGS. 1 and 2 has an outside diameter of 1.26 inches and has grooves about 0.25 inch deep and 0.10 inch wide. The core is 4 inches long.

The core in the embodiment of FIGS. 9–12 using a single core has an outside diameter of 0.5 inches and is 4 inches long. The depth of the central groove is 1/16 inch and the side groove 85 is 3/16 inch. The four core embodiment has a core length of 3 inches. In another embodiment the outside cover or housing may be made of Parker 821 push-lok hose with a copper lining. This hose is widely used in the automotive and diesel industries. This hose is recommended for all petroleum based fluids and is rated with a temperature range of 40° F. to +212° F. This hose has an inside diameter of $\frac{5}{8}$ inches and an outside diameter of 0.91 inches. This hose is rated at 250 psi working pressure and 1000 psi bursting pressure. The flow rates for the above discussed devices are 3.0 GPM on the inlet side and 0.35 GMP on the outlet side.

Although the present invention has been described with a certain degree of particularity, it is understood that the present disclosure has been made by way of example and that changes in details of structure may be made without departing from the spirit thereof.

What is claimed is:

1. A cast alloy article for improving the combustion efficiency and characteristics of liquid fuels comprising:

a fluted, solid, cast body having coarse and irregular surface contour of interspersed dendritic and interdendritic areas with peaks, valleys and pores that provide for increased surface area for increased fluid contact and for increased turbulence in fluid flow, said surface contour of said body having about a 60 to 80 grit finish, said body having weight amounts of about 41–45% copper, about 18–24% nickel, about 28–31% zinc and about 6–8% tin, said cast body being of cylindrical form having a generally circular cross section with circumferentially spaced generally U-shaped longitudinal peripheral grooves along which fluid flow is passed that provide for increased surface area for increased fluid contact and for turbulence in fluid flow, said body having a size related to a flow rate that accomplishes turbulent fluid flow.

2. A cast alloy article in the form of a cast alloy body made by the method comprising the steps of:

heating metals having weight amounts of about 41–45% copper, about 18–24% nickel, about 28–31% zinc and about 6–8% tin to a high temperature above about 2000° F. but not in excess of 2400° F. to produce molten metals, intermixing the molten metals, pouring the mixed molten metals into a sand mold having sand between about 80 mesh to 140 mesh to provide a poured body, slowly cooling said poured body immediately after reaching said high temperature by retaining said poured body at a temperature from about 2000° F. down to about 800° F. in a period of about 24 hours, to provide a fluted, solid, cast body having a coarse, irregular surface contour of interspersed dendritic areas and interdendritic areas with peaks, valleys and pores that provide for increased surface area for increased fluid contact and for turbulence in fluid flow, said surface contour of said body having about a 60 to 80 grit finish, said body having a size related to fluid flow rate to accomplish turbulent fluid flow.

3. A cast alloy article comprising:

a fluted, solid, cast body having coarse and irregular surface contour of interspersed peaks, valleys and pores, said body having interspersed dendritic areas and interdendritic areas, said surface contour of said body having about a 60 to 80 grit finish, said body having weight amounts of about 41–45% copper, about 18–24% nickel, about 28–31% zinc and about 6–8% tin, each dendritic area being solid dendrites that have a tree-like branching pattern, each interdendritic area being solid metal, said body having a size related to fluid flow rate to accomplish turbulent fluid flow.

4. A method of making a cast alloy article for improving the combustion efficiency and characteristics of liquid fuels comprising the steps of:

heating metals having weight amounts of about 41–45% copper, about 18–24% nickel, about 28–31% zinc and about 6–8% tin to a high temperature above about 2000° F. but not in excess of 2400° F. to produce molten metals, thoroughly intermixing the molten metals, pouring the mixed molten metals into a sand mold having sand between about 80 mesh to 140 mesh to provide a poured body, slowly cooling the poured body immediately after reaching said high temperature by retaining said poured body at a temperature between about 2000° F. and 800° F. for a period of about 24 hours to provide a fluted, solid, cast body having a coarse, irregular surface contour of interspersed dendritic areas and interdendritic areas with peaks, valleys and pores that provide for increased surface area for increased fluid contact and for increased turbulence in fluid flow, said surface contour of said body having about a 60 to 80 grit finish, said body having a size related to fluid flow rate to accomplish turbulent fluid flow.

5. A method of making a cast alloy article as set forth in claim 4 with said sand mold having sand of about 100 black.

6. A method of making a cast alloy article as set forth in claim 4 with said sand mold having sand of about 120 olivine.

7. A method of enhancing the combustion efficiency of liquid fuels comprising the steps of contacting a liquid fuel with a cast alloy article comprising:

a cast body having coarse and irregular surface contour of interspersed peaks, valleys and pores that provide for increased surface area for increased fluid contact and for increased turbulence in fluid flow, said surface contour of said body having about a 60 to 80 grit finish, said body having weight amounts of about 41–45% copper, about 18–24% nickel, about 28–31% zinc and about 6–8% tin.

8. A cast alloy article as set forth in claim 1 wherein said quantities of selected metals have by weight amounts of about 44% copper, about 19% nickel, about 30% zinc and about 7% tin.

9. A method as set forth in claim 7 wherein said quantities of selected metals have by weight amounts of about 44% copper, about 19% nickel, about 30% zinc and about 7% tin.

10. A cast alloy article as set forth in claim 3 wherein said quantities of selected metals have by weight amounts of about 44% copper, about 19% nickel, about 30% zinc and about 7% tin.

11. A method as set forth in claim 4 wherein said quantities of metals have by weight amounts of about 44% copper, about 19% nickel, about 30% zinc and about 7% tin.

12. A cast alloy article in the form of a cast alloy body made by the method comprising the steps of heating a batch of metals having weight amounts of about 41–45% copper, about 18–24% nickel, about 28–31% zinc and about 6–8% tin to a high temperature above about 2000° F. but not in excess of 2400° F. to produce molten metals, intermixing the molten metals, plunging zinc in an amount of about 10% by weight of the total batch into the bottom of the molten metal and stirring the molten metal, pouring the mixed molten metals into a sand mold having sand between about 80 mesh to 140 mesh to provide a poured body, slowly cooling said poured body immediately after reaching said high temperature by retaining said poured body at a temperature between about 2000° F. and 800° F. for a period of about 24 hours to provide a fluted, solid, cast body having a coarse, irregular surface contour of interspersed dendritic areas and interdendritic areas with peaks, valleys and pores that provide for increased surface area for increased fluid contact and for increased turbulence in fluid flow, said surface contour of said body having about a 60 to 80 grit finish, said body having a size related to fluid flow rate to accomplish turbulent fluid flow.

13. A method of making a cast alloy article for improving the combustion efficiency and characteristics of liquid fuels comprising the steps of:

heating a batch of metals having weight amounts of about 41–45% copper, about 18–24% nickel, about 28–31% zinc and about 6–8% tin to a high temperature above about 2000° F. but not in excess of 2400° F. to produce molten metals, thoroughly intermixing the molten metals, plunging zinc in an amount of about 10% by weight of the total batch into the bottom of the molten metal and stirring the molten metal, pouring the mixed molten metals into a sand mold having sand between about 80 mesh to 140 mesh, slowly cooling the poured metals immediately after reaching said high temperature by retaining said poured body at a temperature between about 2000° F. and 800° F. for a period of about 24 hours to provide a fluted, solid, cast body having a coarse, irregular surface contour of interspersed dendritic areas and interdendritic areas with peaks, valleys and pores that provide for increased surface area for increased fluid contact and for increased turbulence in fluid flow, said surface contour of said body having about a 60 to 80 grit finish, said body having a size related to fluid flow rate to accomplish turbulent fluid flow.

14. A cast alloy article as set forth in claim 1 wherein there are two laterally spaced grooves on opposite sides of a vertical center line of said body and a generally L-shaped groove laterally outside of each two laterally spaced grooves on each half section of said body, said cast body having a relatively shiny surface.

15. A cast alloy article as set forth in claim 3 wherein said dendritic areas have dendrites with a center to center spacing between each dendrite of about 0.001 to about 0.002 inch.

16. A cast alloy article as set forth in claim 3 wherein the surface of said cast body has peaks and valleys with the peaks being hardened and the valleys being fractured to become porous to open the grain of the metal in said dendritic areas.

17. A cast alloy article as set forth in claim 2, said slow cooling increasing crystal structure size by growing larger dendrites in said dendrite area, said dendrites having a center to center spacing between each dendrite of about 0.001 to about 0.002 inch.

18. A method as set forth in claim 4 wherein said slow cooling increasing crystal structure size by growing larger dendrites in said dendrite area, said dendrites having a center to center spacing between each dendrite of about 0.001 to about 0.002 inch.

19. A method as set forth in claim 4 including the step of securing sand of the same size as the mold sand to the outside of a mold pattern to form impressions in the said mold to form a coarse surface in said cast body.

20. A fuel filter comprising:

a metal housing, at least one core in said housing, said core being a cast alloy body having coarse and irregular surface contour of interspersed dendritic and interdendritic areas with peaks, valleys and pores that provide for increased surface area for increased fluid contact and for increased turbulence in fluid flow, said surface contour of said body having about a 60 to 80 grit finish, said body having weight amounts of about 41–45% copper, about 18–24% nickel, about 28–31% zinc and about 6–8% tin, metal particles of the same material as said core, said particles surrounding said core, an intermediate fuel filter disposed between said housing and said core, an inlet end cap defining a flow inlet and an outlet end cap defining a flow outlet, said inlet and outlet end caps being at opposite ends of said housing, an inlet fuel filter in said inlet end cap upstream of an inlet end of said body and an outlet fuel filter in said outlet end cap downstream of an outlet end of said body, whereby a fuel is passed through said flow inlet, said inlet fuel filter, over said core and said particles, through said intermediate fuel filter, through said outlet fuel filter and out said flow outlet.

21. A fuel filter as set forth in claim 20, said core having grooves in the periphery with peak portions on each side of said grooves and wherein there are four of said cores of a similar size and shape and circumferentially arranged about a longitudinal center line of said housing with one of said cores being disposed in each of four quadrants of a circle and having peak portions of adjacent of said cores touching to form a central longitudinal flow passage between said cores.

22. A fuel filter as set forth in claim 21 wherein each core has a generally circular cross section and is grooved having at least one first groove in the periphery extending along a first center line through the center of said core with a pair of spaced first and second peak portions on each side of said first groove and a first and second side groove at the side of said first and second peak portions, said core having a second groove opposite said first groove and a pair of spaced third and fourth peak portions opposite said first and second peak portions, respectively, and a third and fourth side groove portion opposite said first and second side groove portions extending along said second groove a center line transverse to said first center line.

23. A fuel filter as set forth in claim 20 wherein the flow rate of the fuel is about 3.0 GPM at the inlet and about 0.35 GPM at the outlet.

* * * * *